United States Patent [19]

Sumigawa

[11] Patent Number: 4,701,141

[45] Date of Patent: Oct. 20, 1987

[54] STEERING DEVICE FOR AN OUTBOARD MOTOR

[75] Inventor: Yukio Sumigawa, Iwata, Japan

[73] Assignee: Sanshin Kogyo Kabushiki Kaisha, Japan

[21] Appl. No.: 5,352

[22] Filed: Jan. 13, 1987

Related U.S. Application Data

[63] Continuation of Ser. No. 749,388, Jun. 27, 1985, abandoned.

[30] Foreign Application Priority Data

Jul. 25, 1984 [JP] Japan ..... 59-153186

[51] Int. Cl.[4] ..... B63H 25/02

[52] U.S. Cl. ..... 440/55; 440/56; 74/495; 74/527; 114/144 R; 180/133

[58] Field of Search ..... 440/55, 56, 63; 114/144 R; 74/475, 480 B, 495, 527, 536; 180/133

[56] References Cited

U.S. PATENT DOCUMENTS 1,452,900 4/1923 Turner .
1,593,823 7/1926 Gleason .
2,182,596 12/1939 Olsen .
2,221,101 11/1940 Lefkowitz .
2,426,001 8/1947 Denault .
2,846,896 8/1958 Allen .
3,164,032 1/1965 Abbey .
3,310,021 3/1967 Shimanckas .
3,463,032 8/1969 Murphy .
3,756,186 9/1973 Nordling ..... 440/63
4,521,201 6/1985 Watanabe ..... 440/55

FOREIGN PATENT DOCUMENTS 100299 8/1975 Japan .

*Primary Examiner*—Joseph F. Peters, Jr.
*Assistant Examiner*—Thomas J. Brahan
*Attorney, Agent, or Firm*—Ernest A. Beutler

[57] ABSTRACT

Several embodiments of steering devices for outboard motors that are operative to hold the outboard motor in a steered position but which will release upon emergency application due to fracturing of a frangible member. In each embodiment, the steering device comprises a pin that is movable into and out of engagement with an opening formed in the other of the members. In some of the embodiments, the member in which the opening is formed is frangible and, in another, the pin is frangible.

6 Claims, 7 Drawing Figures

STEERING DEVICE FOR AN OUTBOARD MOTOR is a continuation of U.S. patent application Ser. No. 749,388, filed June 27, 1985, now abandoned.

BACKGROUND OF THE INVENTION

This invention relates to a steering device for an outboard motor and more particularly to an improved steering device for holding the outboard motor in a steered position and which may be conveniently released for steering under emergency conditions.

As is well known, outboard motors are normally provided with a tiller and the operator must keep his hand on the tiller at all times to hold the motor in a steered condition. However, this can be tiresome to the operator, particularly when travelling in long distances and along a generally predetermined straight path. For this purpose, various devices have been proposed for locking the outboard motor in a steered condition. Such devices are manually operable between a released position and a locked position and in this latter position hold the motor in a predetermined, and normally straight ahead, condition. It is desirable, however, to provide an arrangement wherein the operator may quickly steer the motor under an emergency condition without the necessity of having to separately releaase the steering lock device. However, the automatic release should be such that it will not become inadvertently released under the forces that are applied to the outboard motor during normal operation.

In the copending Application Ser. No. 467,304, filed Feb. 17, 1983 entitled "Steering Device For An Outboard Motor", and assigned to the same assignee of this application, there is diclosed a very satisfactory arrangement for holding a motor in a steered position and which operaters so as to be automatically released under emergency conditions. In the device shown in the aforenoted copending application, a locking pin cooperates with a spring-like retaining member and can be conveniently released when sufficient force is applied. However, under some circumstances, it has been found that the release is not as effective as might be hoped for. That is, with the type of device shown in that application, the locking pin may be inserted too deeply into the retaining spring so as to permit effective emergency release.

It is, therefore, a principal object of this invention to provide an improved steering device for an outboard motor.

It is further object of this invention to provide an outboard motor steering device that will hold the motor in a steered condition but which will be readily releasable under emergency conditions so as to permit steering.

SUMMARY OF THE INVENTION

This invention is adapted to be embodied in a steering device for an outboard motor that is adapted to be affixed to the transom of an associated watercraft and which is supported for steering movement about a generally vertically extending steering axis. The steering device comprises a first member that is adapted to be affixed to the transom and a second member that is adapted to be affixed to the outboard motor. Means support the first and second members for relative movement between a disengaged position wherein the motor may be steered about the steering axis and an engaged position wherein the outboard motor is held against movement about the steering axis. In accordance with the invention, at least one of the members is frangible for fracture thereof to release the outboard motor for steering movement about the steering axis when the members are in their engaged position and when a predetermined emergency force is applied to the outboard motor to steer it.

DETAILED DESCRIPTION OF THE PREFERRED EMBODIMENTS

Figure 1:
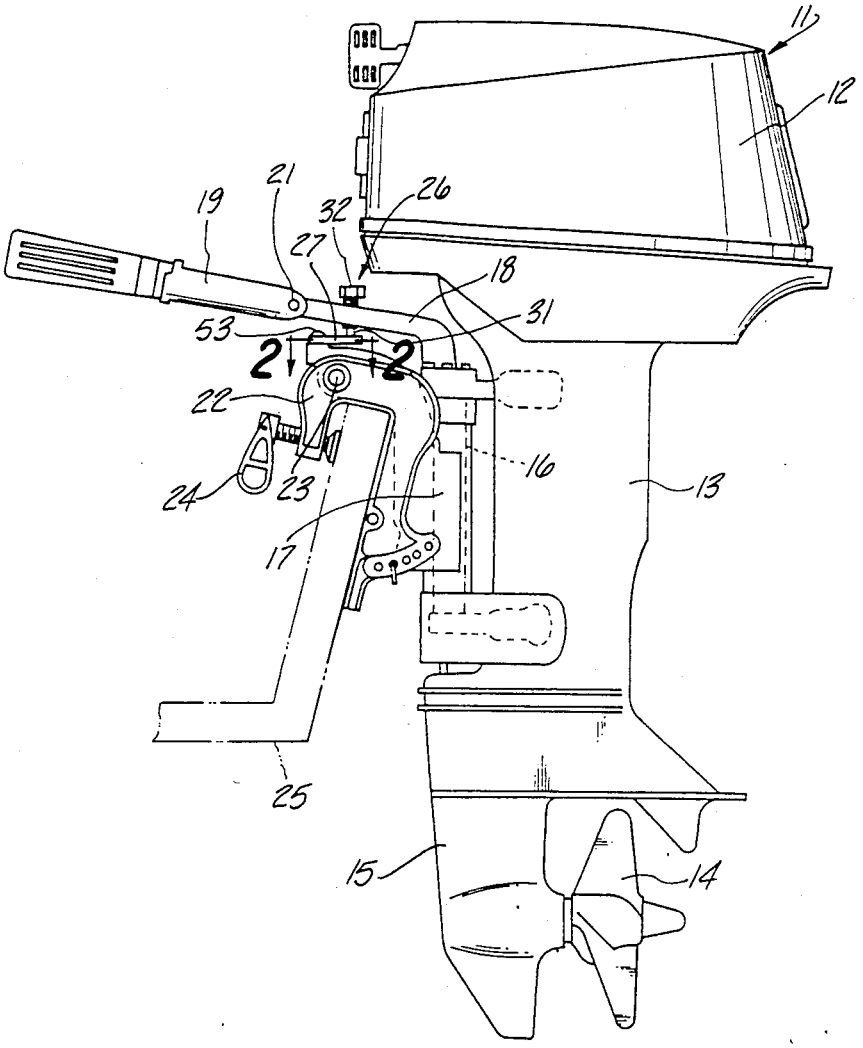
FIG. 1 is a side elevational view of an outboard motor having a steering device constructed in accordance with a first embodiment of the invention and attached to the transom of an associated watercraft, shown in phantom.
Figure 2:
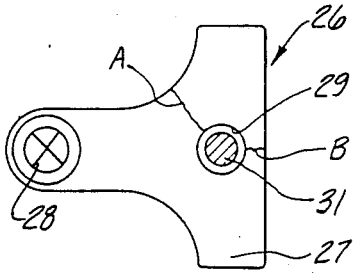
FIG. 2 is an enlarged cross-sectional view taken along the line 2—2 of FIG. 1.

Referring first to the embodiment of FIGS. 1 and 2, an outboard motor constructed in accordance with this embodiment is identified generally by the reference numeral 11. The outboard motor 11 includes a power head 12 consisting of an internal combustion engine and a surrounding protective cowling. A drive shaft housing 13 depends from the power head and contains a drive shaft (not shown) that is driven by the engine of the power head 12. A propeller 14 is suppported by a lower unit 15 and is driven from the drive shaft by means of a suitable drive arrangement which may include a forward, neutral, reverse transmission.

A steering shaft 16 is affixed to the drive shaft housing in a suitable manner and is journaled for rotation within a swivel bracket 17 for steering movement of the outboard motor 11 about a generally vertically extending steering axis. This steering movement is controlled by means of a steering arm 18 that is affixed to or formed integrally with the upper end of the steering shaft 16 and which extends forwardly. A tiller 19 is pivotally connected to the steering arm 18 by means of a pivot pin 21 so that the tiller 19 may be pivoted about a horizontally disposed axis to an upper, out of the way position.

The swivel bracket 17 is pivotally connected to a clamping bracket 22 by means of a pivot pin 23 for tilting movement of the outboard motor 11 about a generally horizontally disposed tilt axis. The clamping bracket 12, in turn, carries a clamping means 24 so as to permit attachment of the outboard motor 11 to a transom of an associated watercraft, shown partially in phantom and identified by the reference numeral 25.

In accordance with this embodiment of the invention, a steering device, indicated generally by the reference numeral 26, is provided for selectively locking the outboard motor 11 in a predetermined steered position. This predetermined steered position is normally a straight ahead position, however, it can be any of a plurality of predetermined and preselected positions.

The steering device 26 is comprised of a first member, indicated generally by the reference numeral 27, and which has a generally T shape. The member 27 is non-rotatably affixed to the clamping bracket 12 by means including a fastener 28. The member 27 is provided with a cylindrical opening or hole 29 that is adapted to receive a cylindrical portion 31 of a second member 32 of the steering device 26. The second member 32 is carried by the steering arm 18 and is vertically movable between an upper, released position wherein the portion 31 is not disposed within the hole 29 and the motor 11 may be freely steered and a lowered locked position wherein the cylindrical portion 31 enters into the hold 29 and retains the motor 11 in a predetermined steered position. A suitable mechanism may be employed for supporting the member 32 for such vertical movement, for example, the arrangement as will be described in conjunction with the embodiment of FIGS. 3 through 5.

In accordance with this embodiment of the invention, the member 27 is formed from a readily frangible material such as aluminum or a suitable plastic. As a result, the member 27 is sufficiently strong so as to hold the motor 11 in a steered position when the cylindrical portion 31 is in the opening 29. However, if an emergency condition arises, the operator need merely grasp the tiller 19 and force the motor 11 in the desired direction of steering. If this is in a clockwise direction as viewed in FIG. 2, the pin 31 will cause the member 27 to shear along the lines A and B so that the motor can be easily steered in this direction. It should be readily apparent that shearing in the opposite direction is equally possible.

Figure 3:
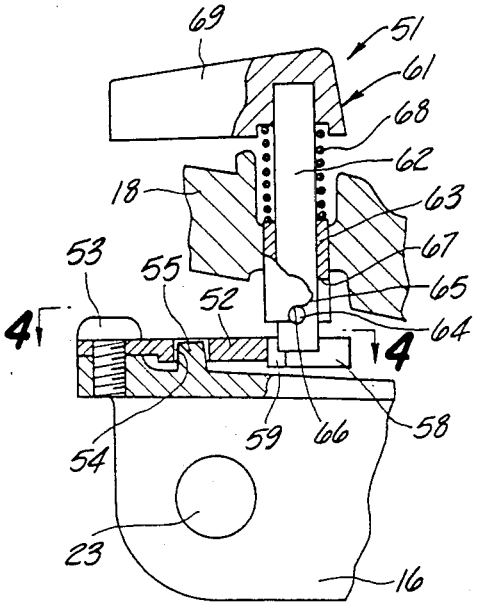
FIG. 3 is an enlarged, vertical cross-sectional view taken through a steering device constructed in accordance with a second embodiment of the invention as attached to an outboard motor and in an engaged position.
Figure 5:
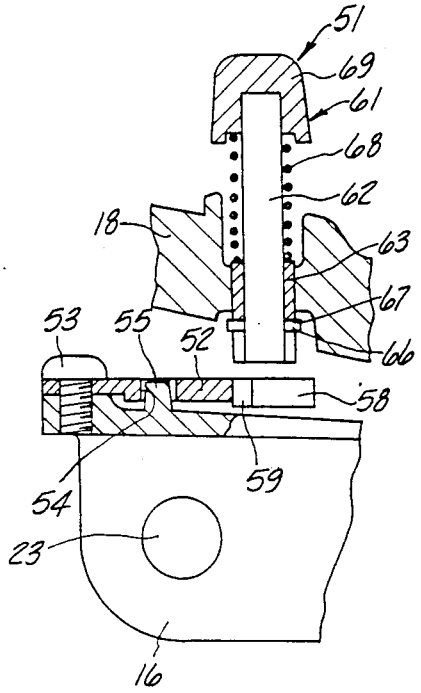
FIG. 5 is a cross-sectional view, in part similar to FIG. 3, showing the steering device in a released position.
Figure 4:
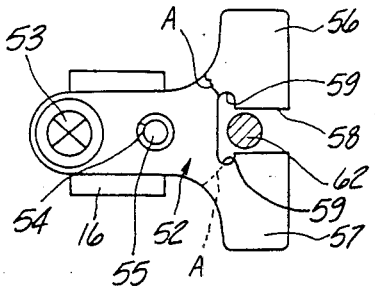
FIG. 4 is a cross-sectional view taken along the line 4—4 of FIG. 3.

FIGS. 3 through 5 show another embodiment of the invention. In this embodiment, only the steering device, which is indicated generally by the reference numeral 51, is shown in its association with the steering handle 18 and swivel bracket 17.

In this embodiment, the steering device 51 includes a generally T shaped member 52 that is affixed to the swivel bracket 17 by means of a threaded fastener 53. In addition, a bore 54 in the member 52 passes a pin-like projection 55 of the swivel bracket 17 so as to assist in holding the member 52 in a fixed angular position.

As in the embodiment of FIGS. 1 and 2, the member 52 is generally of T shape, but in this embodiment the legs 56 and 57 are separated by a central slot 58. The slot 58 is formed, at its base, with a pair of notched areas 59 so as to provide a weakening in this area, for a reason to be described.

The steering device 51 includes a second member, indicated generally by the reference numeral 61, which includes a pin part 62 that is slidably received and rotatable in a sleeve 63 that is affixed to an opening in the steering arm 18. The pin 62 carries a transverse pin 64 at its lower end that is received in a helically shaped groove 65 that has a lower, engaged detent portion 66 and upper, released detent portion 67. A compression spring 68 encircles the upper portion of the pin 62 and urges its transverse pin 64 into engagement with the groove 67. A handle 69 is affixed to the upper end of the pin 62 so as to facilitate its operation by the operator.

FIG. 5 shows the device 51 in its released position. In this position, the handle 69 extends transversely and the pin 66 will be held in the upper detent slot 67 so that the lower end of the pin 62 will be clear of the recess 58 in the member 52. If the operator desires to maintain the motor 11 in a steered condition, he will move the motor to its central or straight ahead position and rotate the lever 69 from the position shown in FIG. 5 to the position shown in FIG. 3. Upon such rotation, the pin 61 will be cammed by the shape of the slot 65 downwardly so that the lower portion of the pin 62 enters the recess 58 and it will then be held in this position by the detent portion 66. The motor 11 will then operate in a straight ahead position. The steering mechanism 51 may be manually released by rotating the handle 69 back to the position shown in FIG. 5.

In the event of an emergency situation, however, the operator need only grasp the tiller and force it in the desired direction of steering. Then, the member 52 will shear along the lines A that extend between the recesses 59 and the base of the portions 56 and 57 so that the motor 11 can be conveniently steered without the operator having to turn the handle 69 to release the steering device 51. As with the embodiment of FIGS. 1 and 2, the member 52 may be formed from a suitable material so as to facilitate this shearing operation.

Figure 6:
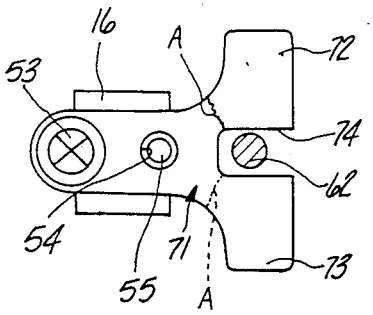
FIG. 6 is a cross-sectional view, in part similar to FIG. 4, showing a third embodiment of the invention.

FIG. 6 shows another embodiment of the invention that is basically similar to the embodiment of FIGS. 3 through 5. In this embodiment, the steering device includes a first member, indicated generally by the reference numeral 71, that is affixed to the swivel bracket 17 in the same manner as with the previously described embodiment and which has a generally T shape. For this reason, components and parts which are the same in construction and operation as the embodiment of FIGS. 3 through 5 have been identified by the same reference numerals and will not be described again in detail. In this embodiment, the T shape consists of a pair of arms 72 and 73 that are separated to form a slot 74 that is adapted to receive a pin 62 of a second member which is the same as the second member of the embodiment of FIGS. 3 through 5. In this embodiment, the notches are not provided, however, there are weakened areas between the bases of the slot and the ends of the arms 72 and 73 so that fractures can occur, for example, along the broken lines A to effect emergency release. This emergency release operation is the same as the embodiment of FIGS. 3 through 5 and thus will not be repeated again.

In connection with each of the embodiments thus far described, the member which is frangible (the member 27 of the embodiment of FIG. 2, the member 52 of the embodiment of FIGS. 3 through 5 and the member 71 of the embodiment of FIG. 6) is readily replaceable by removing of the fastener that holds it in place and reinsertion of a new unbroken member to the swivel bracket.

Figure 7:
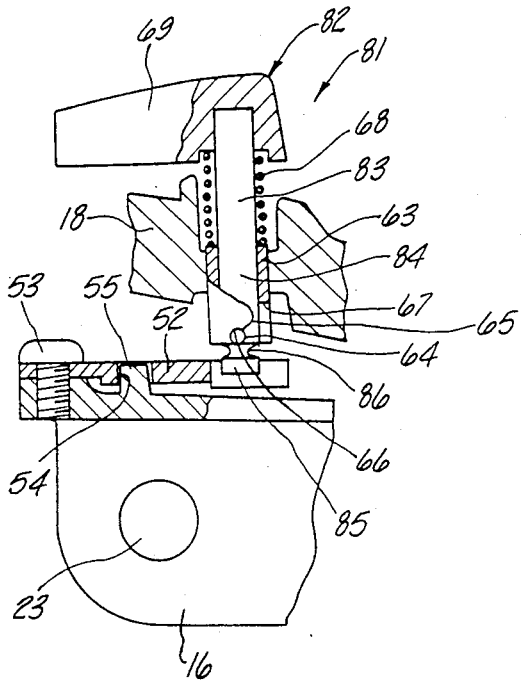
FIG. 7 is a cross-sectional view, in part similar to FIG. 3, showing a fourth embodiment of the invention.

FIG. 7 shows another embodiment of the embodiment wherein the pin or second steering device member is frangible rather than the first member. In this embodiment, the steering device is indicated generally by the reference numeral 81 and includes a first member which may have the form of any of the first members of the embodiments of FIGS. 1 and 2, FIGS. 3 through 5 or FIG. 6. Alternatively, this member may be formed integrally with the swivel bracket 17. However, this first member need not be weakened as with the previously described embodiments for a reason which will become apparent. For illustrative purposes, it may be assumed that the member has a configuration of the embodiment of FIGS. 3 through 5 and the same parts have been identified by the same reference numerals.

In this embodiment, the second member is identified generally by the reference numeral 82 and its construction, except for the lower portion of the locking pin, indicated by the numeral 83 in this embodiment, is the same as the embodiment of FIGS. 3 through 5. Thus components which are the same have been identified by the same reference numerals and will not be described again in detail.

In this embodiment, the pin 83 has an upper cylindrical part 84 to which the cross pin 64 is affixed and which cooperates with the slot 65 as in the embodiment of FIGS. 3 through 5. However, the pin 83 has a lower cylindrical part 85 which is connected to the upper cylindrical part by means of a weakened area 86 of reduced diameter. This weakened area will shear upon emergency force application to the tiller 19 as with the shearing or frangible action of the first members of the previously described embodiments. Thus, the pin 83 should be replaced in this embodiment if it has been broken due to emergency release.

It should be readily apparent from the foregoing description that several embodiments have been illustrated and described each of which permits an effective steering device for holding an outboard motor in a steered position and which is manually operable between an engaged and released position. In addition, however, the device can be readily released upon emergency operation through shearing or breaking of frangible member.

Although a number of embodiments have been illustrated and described, various changes and modifications may be made without departing from the spirit and scope of the invention, as defined by the appended claims.

I claim:

1. In a steering device for an outboard motor or the like adapted to be affixed to the transom of an associated watercraft or the like and supported for steering movement about a generally vertically extending steering axis comprising a first member adapted to be affixed to the transom, and a second member adapted to be affixed to the outboard motor, means for supporting said first and said second members for relative movement between a disengaged position wherein the motor may be steered about the steering axis and an engaged position wherein the outboard motor is held against movement about the steering axis, one of said members comprising a pin and the other of the members comprising a member defining an opening adapted to receive the pin, the pin being supported for movement into and out of engagement with the other member opening, the improvement comprising at least one of said member being frangible for fracture thereof to release the outboard motor for steering movement about the steering axis when said members are in their engaged position and when a predetermined emergency force is applied to the outboard motor to steer it.

2. In a steering device as set forth in claim 1 wherein the frangible member comprises the member in which the opening is formed, said frangible member being made frangible by a weakened area around the opening.

3. In a steering device as set forth in claim 2 wherein the frangible member comprises a leaf spring in which the opening is formed and the weakened area is formed by interconnecting the area defining the opening with the remainder of the leaf spring with a thin section.

4. In a steering device as set forth in claim 3 wherein the opening comprises a slot having a T-shape to define the weakened area.

5. In a steering device as set forth in claim 1 wherein the frangible member comprises the pin.

6. In a steering device as set forth in claim 5 wherein the pin is frangible by having a weakened portion interconnecting a part of the pin that engages the opening with the remaining portion of the pin.

* * * * *